US006268554B1

(12) United States Patent
Ashton

(10) Patent No.: US 6,268,554 B1
(45) Date of Patent: Jul. 31, 2001

(54) MUSIC BOX COMB STRUCTURE FOR PLAYING DUETS

(76) Inventor: Wesley Scott Ashton, 8549 Blackfoot Ct., Lorton, VA (US) 22079

( * ) Notice: Subject to any disclaimer, the term of this patent is extended or adjusted under 35 U.S.C. 154(b) by 0 days.

(21) Appl. No.: 09/693,868

(22) Filed: Oct. 23, 2000

(51) Int. Cl.[7] ..... G10F 1/06
(52) U.S. Cl. ..... 84/95.2; 84/95.2; 84/94.1
(58) Field of Search ..... 84/94.1, 94.2, 84/95.1, 95.2, 96

(56) References Cited

U.S. PATENT DOCUMENTS

| | | | | |
|---|---|---|---|---|
| 356,251 | | 1/1887 | Junod . | |
| 593,761 | | 11/1897 | Brachhausen . | |
| 595,901 | | 12/1897 | Brachhausen . | |
| 2,570,976 | | 10/1951 | Patz | 84/96 |
| 3,016,783 | | 1/1962 | Karraker | 84/464 |
| 4,418,603 | | 12/1983 | Isaka | 84/95 |
| 5,235,123 | * | 8/1993 | Chiang | 84/95.1 |
| 5,721,388 | | 2/1998 | Shih | 84/95.2 |
| 5,973,240 | * | 4/2000 | Isaka | 84/97 |
| 6,051,763 | * | 4/2000 | Poux | 84/95.1 |

FOREIGN PATENT DOCUMENTS 78218 11/1894 (DE) .

* cited by examiner

*Primary Examiner*—Robert E. Nappi
*Assistant Examiner*—Kim Lockett
(74) *Attorney, Agent, or Firm*—Wesley Scott Ashton

(57) ABSTRACT

A comb mounting apparatus for a music box includes a frame, a plurality of musical combs, an actuator drum, and a comb mount assembly, wherein the comb mount assembly includes a base mount, a middle mount and a top mount for mounting, securing and positioning the musical combs relative to the drum actuator so that each musical comb is musically activated by the drum actuator to produce a duet. Further modification divides the middle mount into an upper middle mount and a lower middle mount to allow for additional musical combs to be mounted. Another modification of the comb mounting apparatus utilizes a first comb mount assembly and a second comb mount assembly, and this structure can be further modified to form a comb mounting arch. The invention provides a means for mounting a plurality of musical combs so that the combs may play a duet while minimizing space requirements and construction costs.

19 Claims, 6 Drawing Sheets

MUSIC BOX COMB STRUCTURE FOR PLAYING DUETS

BACKGROUND OF THE INVENTION

1. Field of the Invention

The present invention pertains generally to ornamental music boxes and similar musical displays utilizing a wind-up spring motor or electric motor to drive an actuating drum which engages a comb structure made of an array of slim vibratile reeds to make music by causing the slim vibratile reeds to vibrate. More specifically, the present invention addresses the problem of how to secure multiple combs to engage a single actuator drum to produce aesthetically pleasing duets, such as "Row, row, row you're boat" or "Are you sleeping, Brother John?"

2. Description of the Prior Art

Many people enjoy music boxes, and there are so many kinds available. The typical music box includes an ornamental display such as a scene with figurines in a water filled globe, or as a box having pictures and/or other visual curiosities to admire. Furthermore, the typical music box produces a melody to add an auditory dimension to the aesthetic experience wherein the visual and auditory aspects of the music box generally share a common theme, for example, such as a Christmas scene with the music "Silent night" played. One commonly known and exemplary music box structure is disclosed in U.S. Pat. No. 5,721,388. As shown in FIG. 8, a common music box 900 has a housing 905, a frame 910 usually made of plastic or a metal such as a zinc alloy and placed inside of the housing 905, a comb mounting structure 911 formed integrally with the frame 910, a comb 920 mounted on the comb mounting structure 911 and secured by screws 930. The comb 920 is usually made of metal or plastic and includes a plurality of vibratile reeds 921 for producing a melody in a single key when activated by the drum activator 940. In addition, the music box 900 has a motor 980, either powered by a wind-up spring or by an electric motor, connected to a drive 960 for rotating a drum actuator 940 disposed on the drive 960 like a wheel on an axle. Furthermore, the drive 960 may be connected by a series of gears such as 950 and 951 for transmitting power from the motor to other movable mechanisms (not shown). A limitation to this style of music box is that it has only one drum and one comb, and therefore can not play more complex music such as duets.

U.S. Pat. No. 2,570,976 evinces one solution to the challange of making a music box to play a duet by placing two complete music generating assemblies into the housing, wherein each music generating assembly has its own spring motor, drum actuator, comb and comb mount; however, major drawbacks to this solution include a substantially increased production cost and the need for the music box to be rather large in size. Another music box capable of playing duets is evinced by U.S. Pat. No. 356,251 which uses two drums with two combs engaging each drum such that two combs are arranged contiguously in the same plane and on one side of each drum. Similarily, the drawback to this music box is the large size resulting from the long actuator drums. Lastly, U.S. Pat. No. 593,761 discloses a music box having two combs, each on a separate comb mount, for engaging a star-wheel such that each comb has the same pitch to simultaneously sound a tone with the other comb. Again, the drawback of the music box disclosed by U.S. Pat. No. 593,761 is the large amount of space required to accomodate a second comb mount disposed next to a first comb mount for the benefit of having a second comb engage an actuating device such as a star-wheel or a drum actuator.

SUMMARY OF THE INVENTION

It is a primary object of the present invention to overcome the drawbacks of the prior art music boxes as previously described.

It is another object of the present invention to produce a music box that plays a duet.

It is another object of the present invention to produce a duet playing music box that is space efficient.

It is another object of the present invention to produce a duet playing music box that is inexpensive to manufacture.

The specific feature of the present invention for achieving the desired objectives is an improved comb mounting apparatus for mounting a plurality of musical combs to a frame for operationally engaging an actuator drum having a plurality of projections for striking the vibratile teeth of each of the plurality of combs mounted by the comb mounting apparatus. Each of the combs are stacked vertially above the frame and oriented along a radius of the actuator drum so that each of the plurality of projections of the actuator drum will tangentially engage in a sequence the teeth of each of the plurality of combs to produce music in one or several keys to mimic a duet.

DESCRIPTION OF THE DRAWINGS OF THE INVENTION

FIG. 1 is a plan perspective view of the music box of the present invention.

FIG. 2 a cross sectional view of one embodiment of the comb mounting apparatus of the present invention, viewed through line z—z defined in FIG. 1.

DESCRIPTION OF THE PREFERRED INVENTION AND EMBODIMENTS

Figure 1:
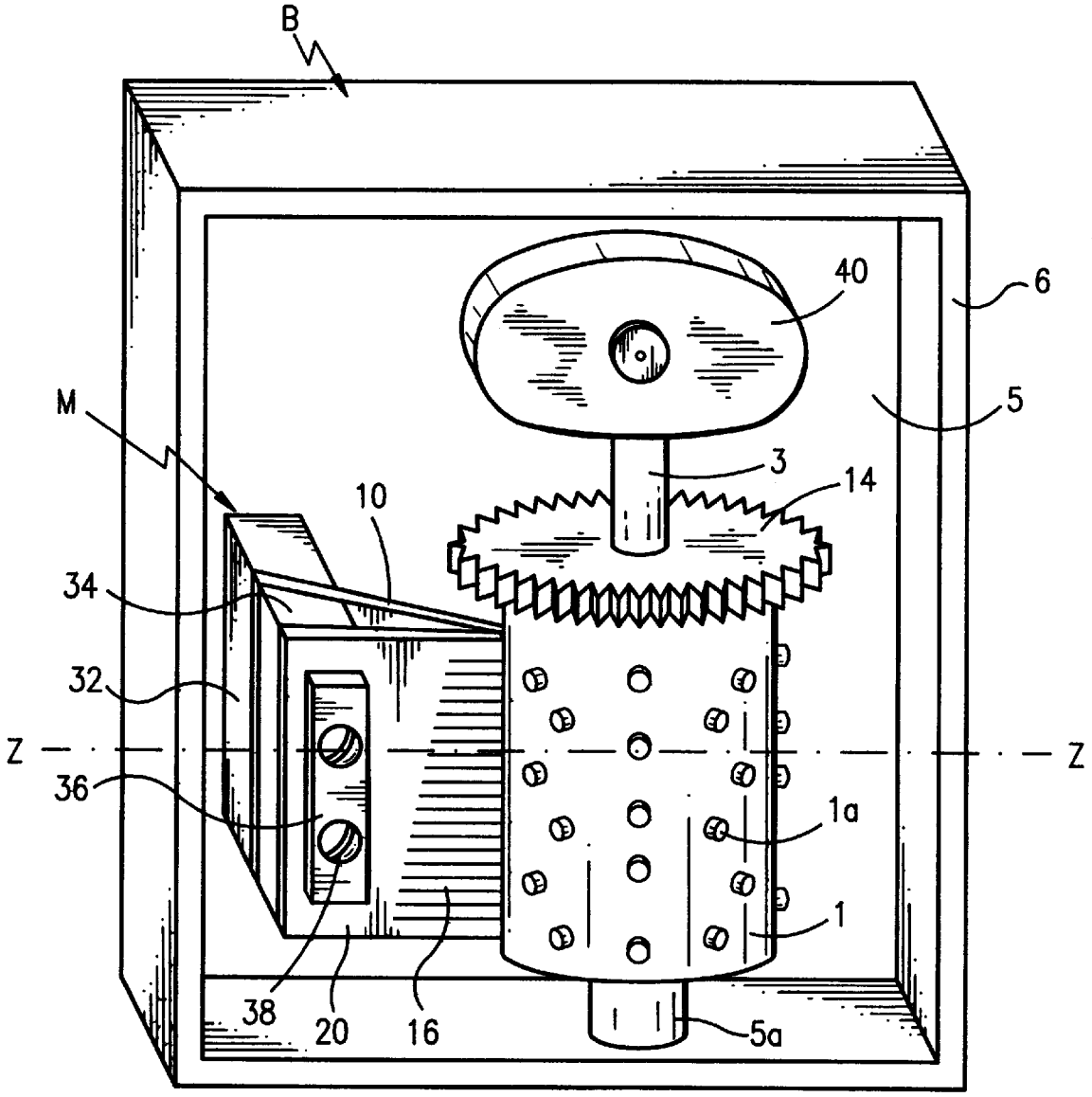

The invention includes a music box (B) as shown in FIGS. 1–4 having a housing (6) typically having a top, bottom and sides made from suitable material such as wood, metal, plastic, ceramics or a combination thereof and a frame (5) made of a durable plastic or metal (ie steel or zinc alloy). The remaining parts of the music box (B) are made of plastic, metal or a combination thereof. A mechnically spring driven motor (40), or alternately an electrically driven motor, is fastened to the frame (5). The motor (40) has a drive shaft (3) having one end operatively connected to the motor (40) while the other end of the drive shaft (3) is supported on the frame (5) by the bearing **(5*a*). The drive shaft (3) transmits power from the motor (40) to at least a drum actuator (1) disposed on the drive shaft (3), whereby the drum actuator (1) is set in rotation by the activation of the motor (40). An optional feature of the invention is that the drive shaft (3) may have a set of gears (14) and (15) operatively connected with the drive shaft (3) for transmitting power from the motor (40) to an animated decoration (not shown) via the transmission gears (14) and (15). The drum actuator (1) has a plurality of surface projections (1***a*) for tangentially engaging a plurality of vibratile teeth (16) of each musical comb (10) and (20), whereby the surface projections (1*a*) set the vibratile teeth (16) into vibratory motion to produce music. The musical combs (10) and (20) may produce music in the same key, or each comb may produce music in a different key.

Figure 2:
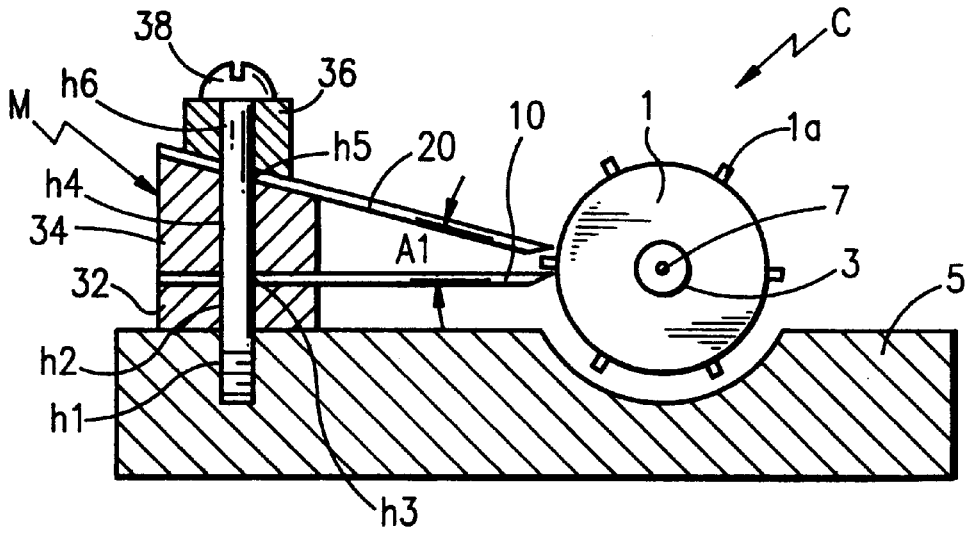

As shown in FIG. 2, the musical combs (10) and (20) are supported in the music box (B) by the comb mounting apparatus (C) which includes the frame (5), the drum actuator (1), the plurality of combs (10) and (20) and a comb mount assembly (M). The comb mount assembly (M) includes a base mount (32), a middle mount (34) and a top mount (36) where each mount (32), (34) and (36) respectively has a plurality of alligned holes (h2), (h4) and (h6) through which a screw or bolt (38) may engage to fasten the mounts (32), (34), and (36), and holes (h3) of comb (10) and holes (h5) of comb (20), along a vertical axis and in a substantially stacked fashion to holes (h1) of the frame (5). Furthermore, the base mount (32) is disposed on the frame (5), while the middle mount (34) is disposed on the base mount (32), and the top mount (36) is disposed on the middle mount (34). The base mount (32) is preferrably integrally formed with the frame (5), but the base mount may be a separate piece as shown in FIG. 2. The comb mount assembly (M) supports, secures and positions the combs (10) and (20) such that the comb (10) is positioned between the base mount (32) and the middle mount (34), and the comb (20) is positioned between the middle mount (34) and the top mount (36). Furthermore, each of the combs (10) and (20) are oriented approximately along a radius of the drum actuator (1) towards the axis of rotation (7) of the drum actuator (1). The angle between comb (10) and comb (20) is A1.

Figure 3:
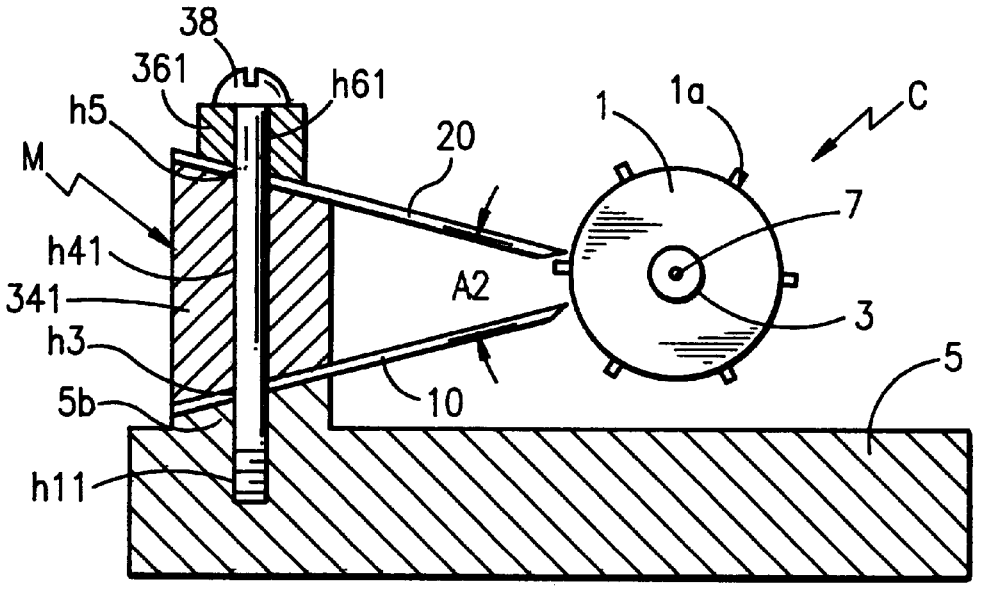
FIG. 3 is a cross sectional view of another embodiment of the comb mounting apparatus of the present invention, viewed through line z—z defined in FIG. 1.

FIG. 3 demonstrates another embodiment of the present invention. The comb mounting apparatus (C) includes the frame (5), drum actuator (1), the combs (10) and (20) and comb mount assembly (M). In this embodiment, the comb mount assembly (M) has base mount (5*b*) formed integrally with frame (5), a middle mount (341) and a top mount (361), wherein each component (5*b*), (341) and (361) respectively have holes (h11), (h41) and (h61) alligned with holes (h3) of comb (10) and (h5) of comb (20) for engaging a screw (38) for fastening the comb mount assembly (M) with the combs (10) and (20) to the frame (5). In this embodiment, the angle A2 between comb (10) and (20) is greater than the angle A1 of the previous embodiment.

Figure 4:
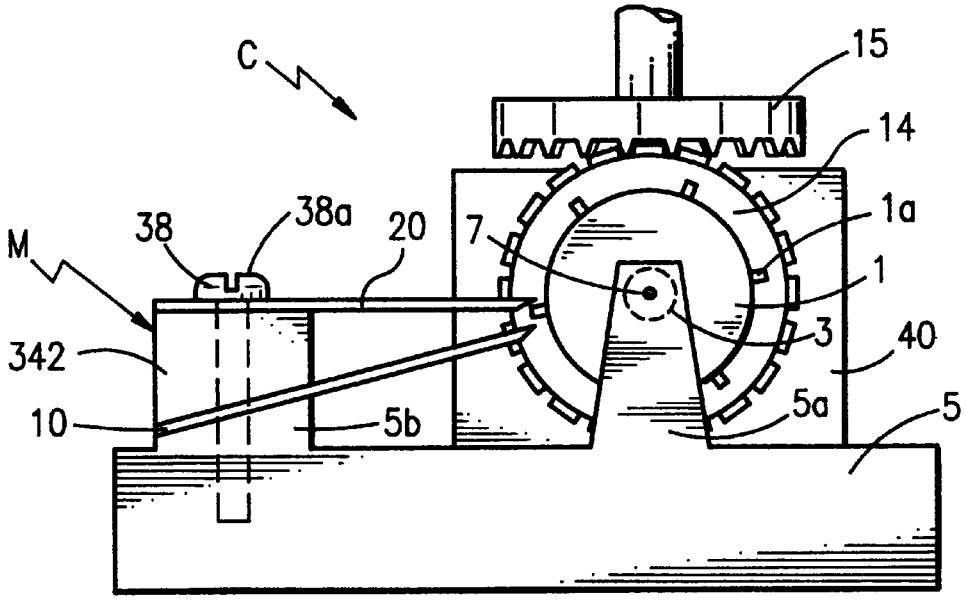
FIG. 4 is a side view of the preferred embodiment of the comb mounting apparatus of the present invention shown in FIG. 1.

FIG. 4 demonstrates the preferred embodiment of the present invention. In this embodiment, the comb mounting apparatus (C) includes frame (5), drum actuator (1), combs (10) and (20), and the comb mount assembly (M). The comb mount assembly (M) has base mount (5*b*) formed integrally with frame (5), a middle mount (342), and the top mount is formed by the heads (38*a*) of the screws (38). Screw (38) is shown by phantom lines as is the drive shaft (3), which is supported by the bearing (5*a*). Lastly, the transmission assembly shown by tooth gear (14) and crown gear (15) is meant to be exemplary and not limiting to the invention. Screw (38) engages the base mount (5*b*), middle mount (342), combs (10) and (20), and frame (5) to mount, secure and position the combs (10) and (20) so that each of the components of the comb mount assembly (M) are stacked vertically so that the combs (10) and (20) are oriented each approximately along a radius of the drum actuator (1) towards the axis of rotation (7) of the drum actuator (1) so that the projections (1*a*) of the drum actuator (1) tangentially engage the vibratile teeth (16) of each of the combs (10) and (20) to make music.

Figure 5:
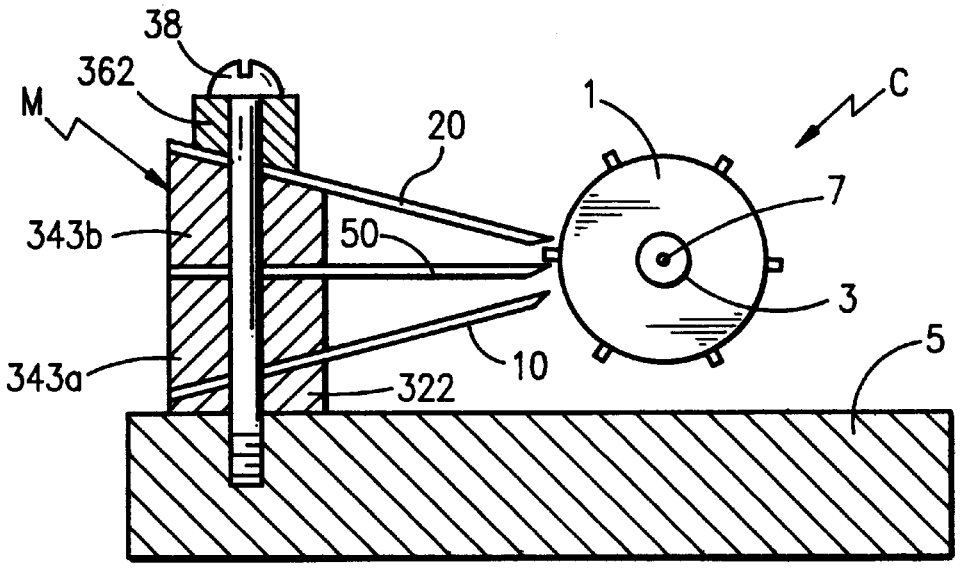
FIG. 5 is a cross sectional view of an embodiment having three combs of the present invention, viewed through line z—z defined in FIG. 1.

FIG. 5 shows yet another embodiment of the present invention. The comb mounting apparatus (C) includes a frame (5), drum actuator (1), a first and second combs (10) and (20) respectively, and comb mount assembly (M); however, the comb mounting apparatus (C) of this embodiment includes a third musical comb (50) and the comb mount assembly (M) includes a base mount (322), a top mount (362), and a two part middle mount having a lower middle mount (343*a*) and an upper middle mount (343*b*). Each of the first, second, and third combs (10), (20) and (50) respectively are mounted, secured and positioned by the comb mount assembly (M) such that the first comb (10) is disposed between the base mount (322) and the lower middle mount (343*a*), the second comb (20) is disposed between the top mount (362) and the upper middle mount (343*b*) and the third comb (50) is disposed between the lower middle mount (343*a*) and the upper middle mount (343*b*) where each of the combs (10), (20), and (50) are oriented approximately along a radius of the actuator drum (1) towards the axis of rotation (7) of the actuator drum (1). Consequently, when the drum actuator (1) is rotated by motor (40) the projections (l*a*) of the drum actuator (1) will be able to activate the vibratile teeth (16) of each of the combs (10), (20) and (50) to produce a three comb "duet." Furthermore, each of the combs (10), (20), and (50) could be in the same key or in different keys.

Figure 6:
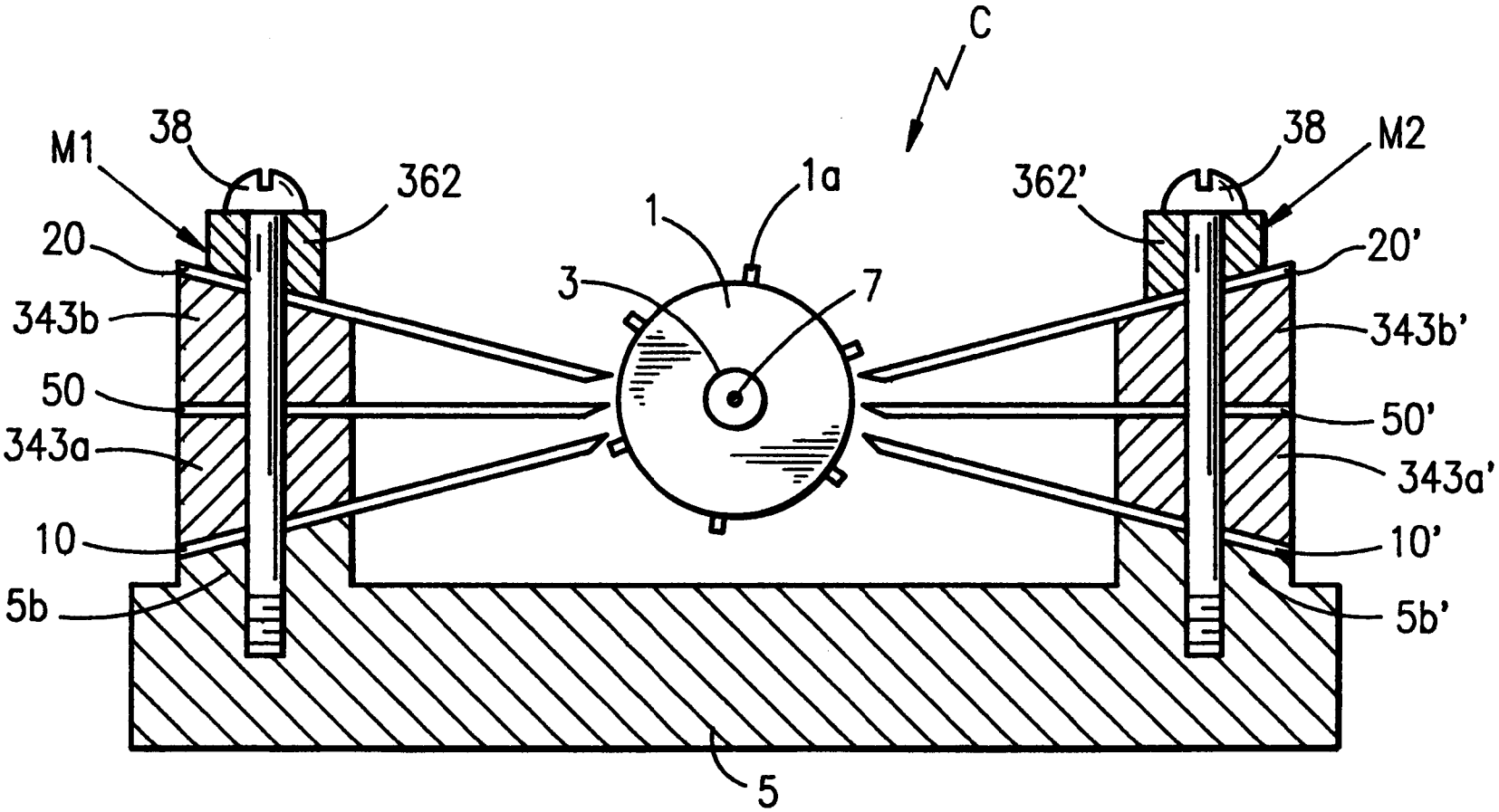
FIG. 6 is a cross sectional view of a comb mounting apparatus having a first comb mounting assembly and a second comb mounting assembly, viewed through a line similar to z—z of FIG. 1.

FIG. 6 illustrates yet another embodiment of the comb mounting apparatus of the present invention comprising of a comb mounting apparatus (C) formed by the drum actuator (1) and two comb mount assemblies (M1) and (M2). As illustrated in FIG. 6, comb mount assembly (M2) is essentially a mirror image of comb mount assembly (M1), both of which engage the drum actuator (1) to make music. Furthermore, although FIG. 6 illustrates six combs mounted to the comb mounting apparatus (C), it is within the scope of this invention to make the comb mount assemblies (M1) and (M2) different from each other. For instance, comb mount assembly (M1) could have three combs while comb mount assembly (M2) might only have one or two combs. Furthermore, the angles between a comb and its adjacent neighbor comb could be varied in a similar manner as illustrated in FIGS. 2 and 3 to produce various lengths of time between the performance of music by each of the combs (10), (10'), (20), (20'), (50) and (50'). Finally, it is understood that each of the combs (10), (10'), (20), (20'), (50) and (50') are playable in the same key, or each of the combs (10), (10'), (20), (20'), (50) and (50') are playable in different keys, or in a combination of same and different keys depending on the desires of the music box builder.

Figure 7:
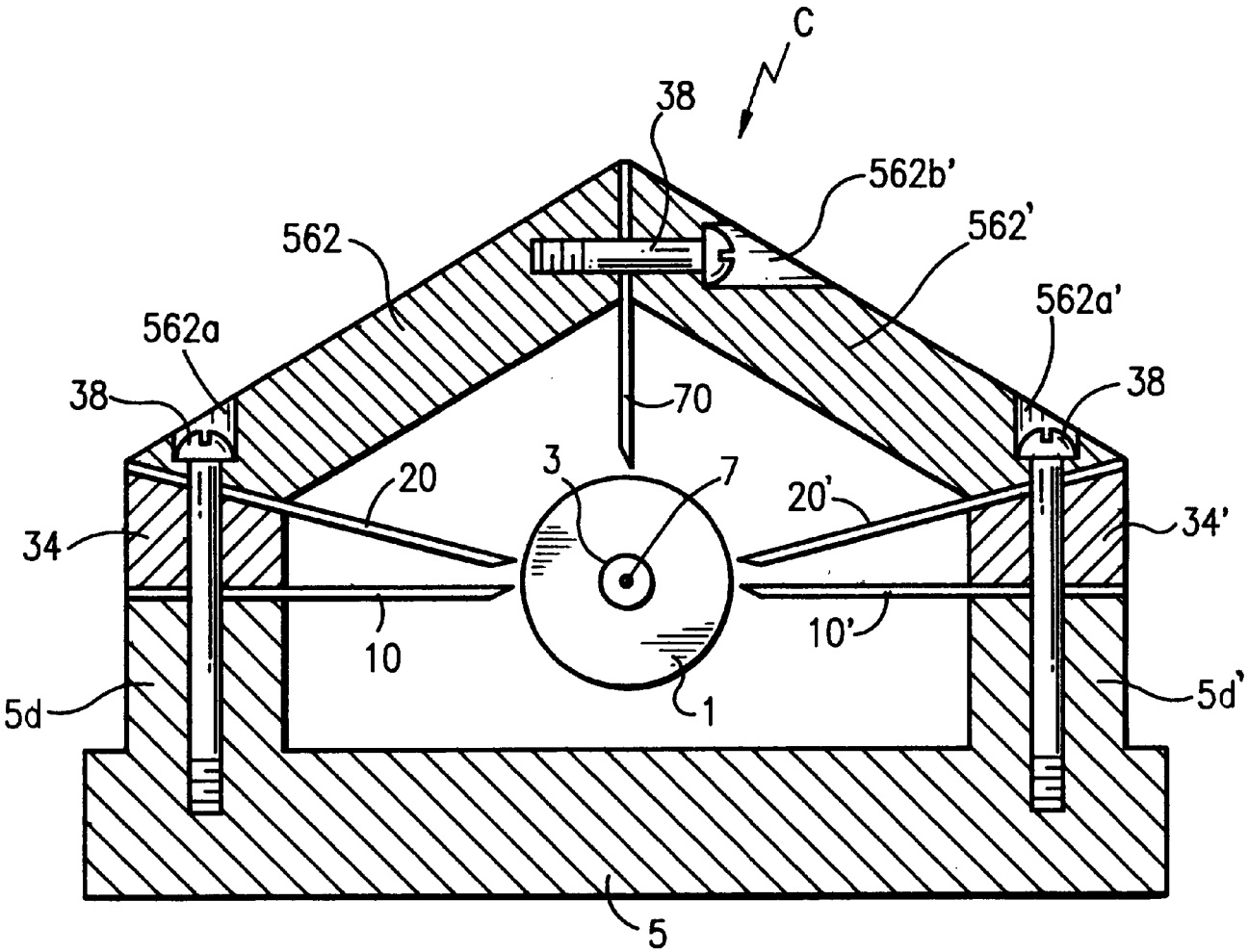
FIG. 7 is a cross sectional view of a comb mounting apparatus forming an arch, viewed through a line similar to z—z defined in FIG. 1.
Figure 8:
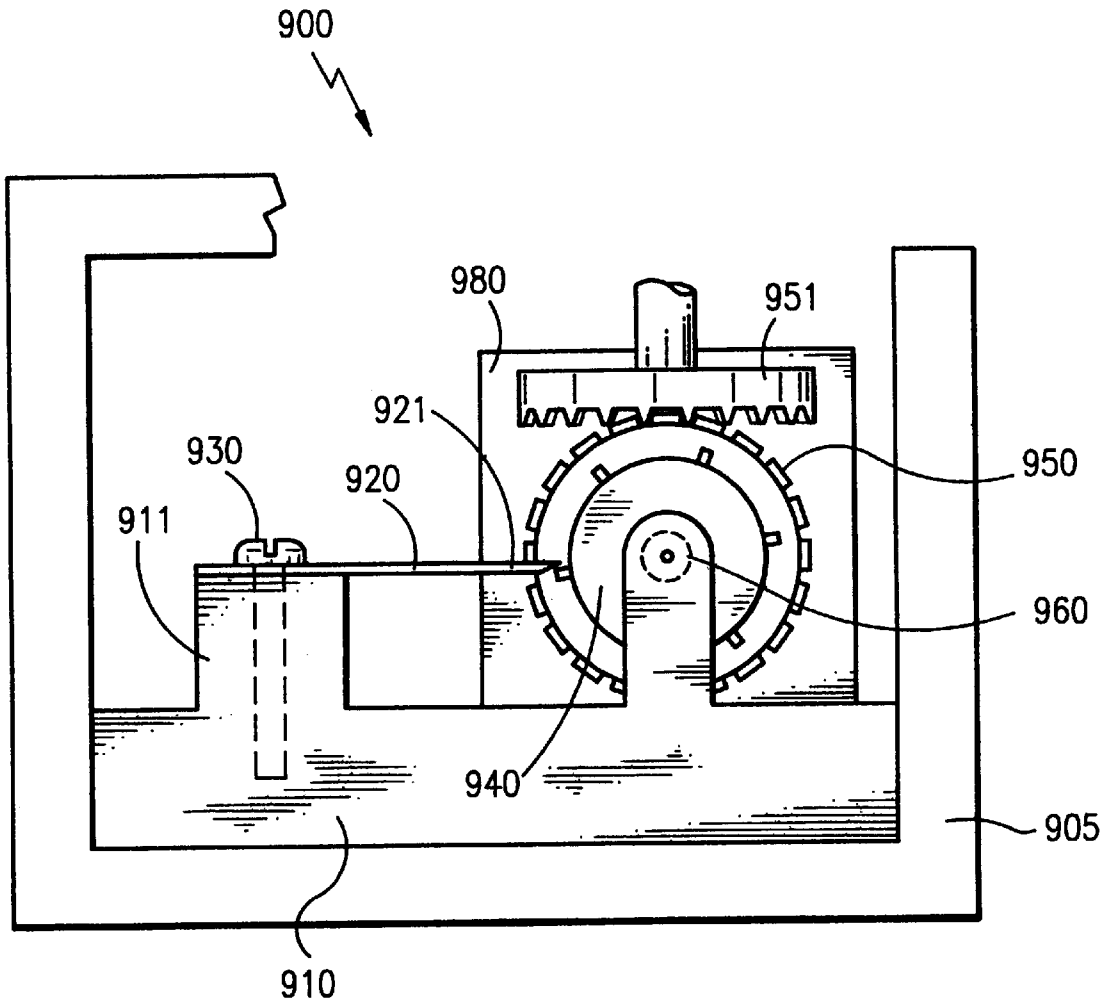
FIG. 8 PRIOR ART
FIG. 8 is a cross sectional view of the prior art comb mounting apparatus, viewed through a line similar to z—z of FIG. 1.

FIG. 7 demonstrates the final embodiment of the present invention, wherein the comb mounting apparatus (C) forms an arch from modified top mounts (562) and (562') that are connected to each other through the arch comb (70) disposed between the modified top mounts (562) and (562').

Therefore, from the description of the invention, its preferred emodiment and variations, it is evident that the improvement in the comb mounting apparatus for a music box substantially includes a frame; a plurality of musical combs, each comb of the plurality of combs playable in the same key, different keys, or in a combination of same and different keys; an actuator drum for engaging the plurality of combs to make music; and a comb mount assembly for arranging the plurality of combs in a vertical fashion with the comb mount assembly being comprised of a base mount, either separate or integral in nature to the frame, a middle mount, and a top mount. It is clear that the middle mount may be further divided into an upper middle mount and a lower middle mount. Furthermore, it is evident that each of the plurality of combs is arranged approximately along a radius of the actuator drum so that teeth for each comb of the plurality of combs will engage the actuator drum along a tangent so that the teeth of each comb of the plurality of combs may strikingly engage the projections of the actuator drum. In addition, one embodiment of the invention has two comb mount assemblies for providing a greater number of combs to bear upon the actuator drum. In another embodiment of the invention, the top mounts for the comb mounting apparatus are modified to connect at an apex to form an arch or steeple. By using either the arch or the two comb mount assembly construction, greater arcs between the combs of the plurality of combs can be achieved, thereby creating a greater pause or delay between the sounds made by each of the plurality of combs while playing a duet.

Lastly, it is noted that the embodients evinced herein in the drawings and the specification are merely illustrations of the preferred embodiment of the invention and its principal variations, and are not meant to be limiting or restrictive, the full spirit and scope of the invention being further defined by the appended claims.

The invention claimed is:

1. A music box comprising:

a housing having a top, a bottom and at least one side;

a frame, positioned inside said housing;

a motor to powerfully drive a drive assembly;

a drive assembly for transmitting power from a motor to a transmission assembly and a drum actuator;

a first comb having a plurality of vibratile tongues for producing a melody in a first key when activated by said drum actuator;

a second comb having a plurality of vibratile tongues for producing a melody in a second key when activated by said drum actuator;

a comb mount assembly for mounting, securing, and supporting said first and second combs to said frame;

a rotatable drum actuator having a plurality of projections for activating the vibratile tongues of said first comb and said second comb to produce a melody, whereby said melody is a duet; and, said rotatable drum actuator is rotated around an axis of rotation by said drive assembly when said music box is in operation.

2. A music box as claimed in claim 1, wherein said comb mount assembly further comprises a base mount, a middle mount, and a top mount; wherein said base mount is disposed on said frame;

said first comb is secured between said base mount and said middle mount, and said second comb is secured between said middle mount and said top mount.

3. A music box as claimed in claim 2, wherein said comb mount positions said first comb so that the vibratile tongues of said first comb point approximately along a radius of said rotatable drum actuator towards said axis of rotation of said rotatable drum actuator;

and, wherein said comb mount positions said second comb so that the vibratile tongues of said second comb point approximately along a radius of said rotatable drum actuator towards said axis of rotation of said rotatable drum actuator.

4. A music box as claimed in claim 3, wherein said base mount, said middle mount, and said top mount are stacked vertically above said frame;

and, a plurality of screws secure said middle mount and said top mount to said base mount such that each screw engages said base mount, said middle mount and said top mount.

5. A music box as claimed in claim 3 and further comprising: a third comb having a plurality of vibratile tongues for producing a melody in a third key; and said middle mount comprises of an upper middle mount and a lower middle mount, wherein said upper middle mount is adjacent to said second comb and said lower middle mount is adjacent to said first comb, and said third comb is secured between said upper middle mount and said lower middle mount.

6. A music box as claimed in claim 1, wherein said comb mount assembly further comprises a base mount and a middle mount;

wherein said base mount is disposed on said frame; and said base mount is formed integrally with said frame; and, said first comb is secured between said base mount and said middle mount, and said second comb is secured between said middle mount and the heads of a plurality of screws.

7. A music box as claimed in claim 6, wherein said comb mount positions said first comb so that the vibratile tongues of said first comb point approximately along a radius of said rotatable drum actuator towards said axis of rotation of said rotatable drum actuator;

and, wherein said comb mount positions said second comb so that the vibratile tongues of said second comb point approximately along a radius of said rotatable drum actuator towards said axis of rotation of said rotatable drum actuator.

8. A music box as claimed in claim 7, wherein said base mount and said middle mount are stacked vertically above said frame; and, said plurality of screws secure said middle mount to said base mount such that each screw engages said base mount and said middle mount.

9. A music box having a housing having a top, a bottom and at least one side, and a comb mounting apparatus for mounting, securing, and positioning a plurality of musical combs, said comb mounting apparatus comprising:

a frame, positioned inside said housing;

a drum actuator disposed on said frame and positioned to engage each comb of said plurality of musical combs to produce music;

said plurality of musical combs further comprises a first comb having a plurality of vibratile tongues for producing a melody in a first key when activated by a drum actuator, and a second comb having a plurality of vibratile tongues for producing a melody in a second key when activated by said drum actuator;

a comb mount assembly for mounting, securing, and supporting said first and second combs to said frame, wherein said comb mount assembly comprises a base mount, a middle mount, and a top mount stacked vertically above said frame, with said base mount disposed on said frame and formed integrally therewith, and said first comb secured between said base mount and said middle mount, and said second comb secured between said middle mount and said top mount.

10. A music box as claimed in claim 9 and further comprising: a third comb having a plurality of vibratile tongues for producing a melody in a third key; and said middle mount comprises of an upper middle mount and a lower middle mount, wherein said upper middle mount is adjacent to said second comb and said lower middle mount is adjacent to said first comb, and said third comb is secured between said upper middle mount and said lower middle mount.

11. A music box having a housing, and a comb mounting apparatus for mounting, securing, and positioning a plurality of musical combs, said comb mounting apparatus comprising:

a frame, positioned inside said housing;

a drum actuator disposed on said frame and positioned to engage each comb of said plurality of musical combs to produce music;

said plurality of musical combs further comprises a first comb having a plurality of vibratile tongues for producing a melody in a first key when activated by a drum actuator, and a second comb having a plurality of vibratile tongues for producing a melody in a second key when activated by said drum actuator;

a comb mount assembly for mounting, securing, and supporting said first and second combs to said frame, wherein said comb mount assembly comprises a base mount and a middle mount, stacked vertically above said frame, with said base mount disposed on said frame, and said first comb secured between said base mount and said middle mount, and said second comb secured between said middle mount and the heads of a plurality of screws.

12. A music box as claimed in claim 11 wherein said base mount is formed integrally with said frame.

13. A music box as claimed in claim 11 and further comprising: a third comb having a plurality of vibratile tongues for producing a melody in a third key; and said middle mount comprises of an upper middle mount and a lower middle mount, wherein said upper middle mount is adjacent to said second comb and said lower middle mount is adjacent to said first comb, and said third comb is secured between said upper middle mount and said lower middle mount.

14. A music box as claimed in claim 13 wherein said base mount is formed integrally with said frame.

15. A music box having a housing and a comb mounting apparatus for mounting, securing, and positioning a plurality of musical combs, said comb mounting apparatus comprising:

a frame, positioned inside said housing;

a drum actuator disposed on said frame and positioned to engage each comb of said plurality of musical combs to produce music;

a first comb mount assembly for mounting, securing, and supporting a first comb, said first comb having a plurality of vibratile tongues for producing a melody in a first key when activated by said drum activator;

a second comb mount assembly for mounting, securing, and supporting a second comb, said second comb having a plurality of vibratile tongues for producing a melody in a second key when activated by said drum activator, and said second comb mount assembly is disposed opposite said first comb mount assembly such that said drum activator is adjacent to both said first comb mount assembly and said second comb mount assembly.

16. A music box as claimed in claim 15, wherein said first comb mount assembly further comprises a first base mount disposed on said frame, and a first top mount wherein said first top mount has an apex end and a proximal end with said proximal end connected to said first base mount; and, wherein said second comb mount assembly further comprises a second base mount disposed on said frame, and a second top mount wherein said second top mount has an apex end and a proximal end with said proximal end connected to said second base mount; and said plurality of musical combs further comprises a third comb having a plurality of vibratile tongues for producing a melody in a third key when activated by said drum activator, wherein said third comb is securedly fastened between said apex end of said first top mount and said apex end of said second top mount to create an arch having said third comb at the apex of said arch.

17. A music box as claimed in claim 16, and said plurality of musical combs further comprises a fourth comb having a plurality of vibratile tongues for producing a melody in a fourth key when activated by said drum activator, wherein said fourth comb is securedly fastened between said proximal end of said first top mount and said first base mount; and, a fifth comb having a plurality of vibratile tongues for producing a melody in a fifth key when activated by said drum activator, wherein said fifth comb is securedly fastened between said proximal end of said second top mount and said second base mount.

18. A music box as claimed in claim 16, wherein said arch positions each comb of said plurality of musical combs so that the vibratile tongues of each comb points approximately along a radius of said rotatable drum actuator towards an axis of rotation for said drum actuator.

19. A music box as claimed in claim 16 wherein said first base mount and said second base mount are formed integrally with said frame.

* * * * *